US008062191B2

(12) United States Patent
Coates

(10) Patent No.: US 8,062,191 B2
(45) Date of Patent: Nov. 22, 2011

(54) RECUMBENT STEPPER

(75) Inventor: Steven John Coates, Newmarket (CA)

(73) Assignee: 7702957 Canda Limited, Newmarket, Ontario (CA)

( * ) Notice: Subject to any disclaimer, the term of this patent is extended or adjusted under 35 U.S.C. 154(b) by 0 days.

(21) Appl. No.: 12/716,055

(22) Filed: Mar. 2, 2010

(65) Prior Publication Data

US 2011/0218078 A1 Sep. 8, 2011

(51) Int. Cl.
*A63B 21/00* (2006.01)

(52) U.S. Cl. ..... 482/57; 482/64; 482/65; 482/61

(58) Field of Classification Search ..... 482/127, 482/114, 121, 115, 130, 142
See application file for complete search history.

(56) References Cited

U.S. PATENT DOCUMENTS 4,739,984 A * 4/1988 Dranselka ..... 482/60
5,116,294 A * 5/1992 Findlay ..... 482/52
5,356,356 A 10/1994 Hildebrandt et al.
6,280,361 B1 * 8/2001 Harvey et al. ..... 482/8
6,790,162 B1 9/2004 Ellis et al.

* cited by examiner

*Primary Examiner* — Jerome W Donnelly
(74) *Attorney, Agent, or Firm* — Lynn C. Schumacher; Hill & Schumacher

(57) ABSTRACT

A recumbent stepper includes a frame, a pair of lever arms, pedals, pulleys, flexible members, springs and adjustable resistance devices The pair of lever arms are pivotally attached to the frame and are movable from a retracted position to an extended position. Pedals are attached to each lever arm. The pair of pulleys are rotatably attached to the frame. The pair of flexible members are attached between the lever arms and pulleys and are wound around the pulley when the lever arm is in the retracted position and deploys as the lever arm moves to the extended position. Springs are operably attached to each pulley such that each lever arm is biased to the retracted position. Adjustable resistance devices are operably connected to each pulleys whereby increasing the resistance on the pulley increases the force required to move the lever from the retracted position toward the extended position.

23 Claims, 12 Drawing Sheets

RECUMBENT STEPPER

FIELD OF THE INVENTION

This invention relates to steppers and in particular recumbent steppers wherein the each leg works independently.

BACKGROUND OF THE INVENTION

The exercise category of steppers includes both upright and recumbent devices designed for both exercise and rehabilitation of certain conditions. Recumbent steppers are a relatively recent addition to the category, originally designed to provide a full body work-out for those recovering from cardiac episodes. Aside from providing cardiovascular exercise, the major advantage of recumbent steppers is their ability to accommodate a joint range of motion (from extension to flexion) of less than 110°, a figure that devices based on circular pedal require.

U.S. Pat. No. 5,356,356 issued Oct. 18, 1994 to Hildebrandt et al. discloses a recumbent exercising device that works both the upper and lower extremities and includes an integrated, adjustable seat. In the Hildebrandt device, the action of the arm levers are coupled together and the action of the foot pedals are coupled together and the upper and lower halves are contralaterally synchronized to simulate a natural "walking" motion. Resistance is generated magnetically, providing constant, smooth, and adjustable effort.

While the action of the lever arms (both upper and lower) and contralateral synchronization provides a familiar and natural motion, the dependence of the lever arms restricts range of motion in the elbow joint and knee joint, respectively, if the range of motion is not identical side-to-side. In other words, each joint is not allowed to work to its respective abilities because the joint with the least range of motion dictates how long the stroke length will be because the motion is dependent.

U.S. Pat. No. 6,790,162 issued September 2004 to Ellis et al. discloses a similar recumbent exercising device, working both the upper and lower extremities and also including an integrated, adjustable seat, but the two foot pedals and two arm levers employ a one-way clutch so that the action of each respective movement is independent and not coupled together as found in the U.S. Pat. No. 5,356,356. In addition in the Ellis device the upper half and lower half are not synchronized in any way. A stop structure is employed to limit movement in both fore/aft directions and resistance is provided by way of eddy current brake. However magnetically (or eddy current) generated resistance is speed dependent, so the resisting force is only constant at a constant operator rate. This device allows each joint to work to its respective abilities due to the use of a one-way clutch and resulting independent movement, but the resisting force is common to both sides. This has the effect of the weakest leg and/or arm dictating the amount of resistance and not allowing the stronger arm and/or leg to work to its muscular ability.

In this single resistance generator arrangement, the resisting force works against all operator inputs. Therefore if more than one limb is moving against the resistance at the same time, the resistance felt by each limb will be less than if fewer (down to one) limbs are moving. This results in a varying resistance felt by the limbs as input movements overlap.

All of these devices transform the linear movement of the operator, into a circular motion about a fixed shaft, by means of a rigid mechanical connection to the shaft. This means the point of operator input, be it a foot pad or handle, travels in an arc centered on the fixed shaft. The result is that the input force of the operator is divided into a radial component and tangential component, relative to this shaft. Only the tangential component of the input force acting through the length of the input lever, creates torque to overcome the resisting torque and cause movement of the shaft and hence lever. Therefore, the current art requires a varying input force to move any input lever against a resisting force. The operator may not notice this variation, but for rehabilitation purposes, this is not a desirable condition and can cause injury to the recovering limb.

Accordingly it would be advantageous to provide a recumbent stepper that has a generally constant resistance force. It would be advantageous to provide a recumbent stepper wherein each pedal is operated independently such that the stroke length may be different for each leg and the resistance may be different for each leg. Further it would be advantageous to provide a recumbent stepper that can easily be used with different chairs including wheel chairs.

SUMMARY OF THE INVENTION

The present invention relates to a recumbent stepper having a frame, a pair of lever arms, pedals, pulleys, flexible members, springs and adjustable resistance devices The pair of lever arms are pivotally attached to the frame and are movable from a retracted position to an extended position. Pedals are attached to each lever arm. The pair of pulleys are rotatably attached to the frame. The pair of flexible members are attached between the lever arms and pulleys and are wound around the pulley when the lever arm is in the retracted position and deploys as the lever arm moves to the extended position. Springs are operably attached to each pulley such that each lever arm is biased to the retracted position. Adjustable resistance devices are operably connected to each pulleys whereby increasing the resistance on the pulley increases the force required to move the lever arm from the retracted position toward the extended position.

In another aspect of the invention there is provided a recumbent stepper having a frame, a pair of lever arms and a pair of pedals. The frame has a hole therethrough and a generally elongate rod adapted to be removably positioned in the hole and extending outwardly on the either side of the frame, whereby the elongate rod is adapted to engage the front legs of a four legged chair. The pair of lever arm systems each have a lever arm pivotally attached to the frame whereby each lever arm is movable from a retracted position to an extended position The pair of pedals are pivotally attached proximate to the distal end of the respective lever arm.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
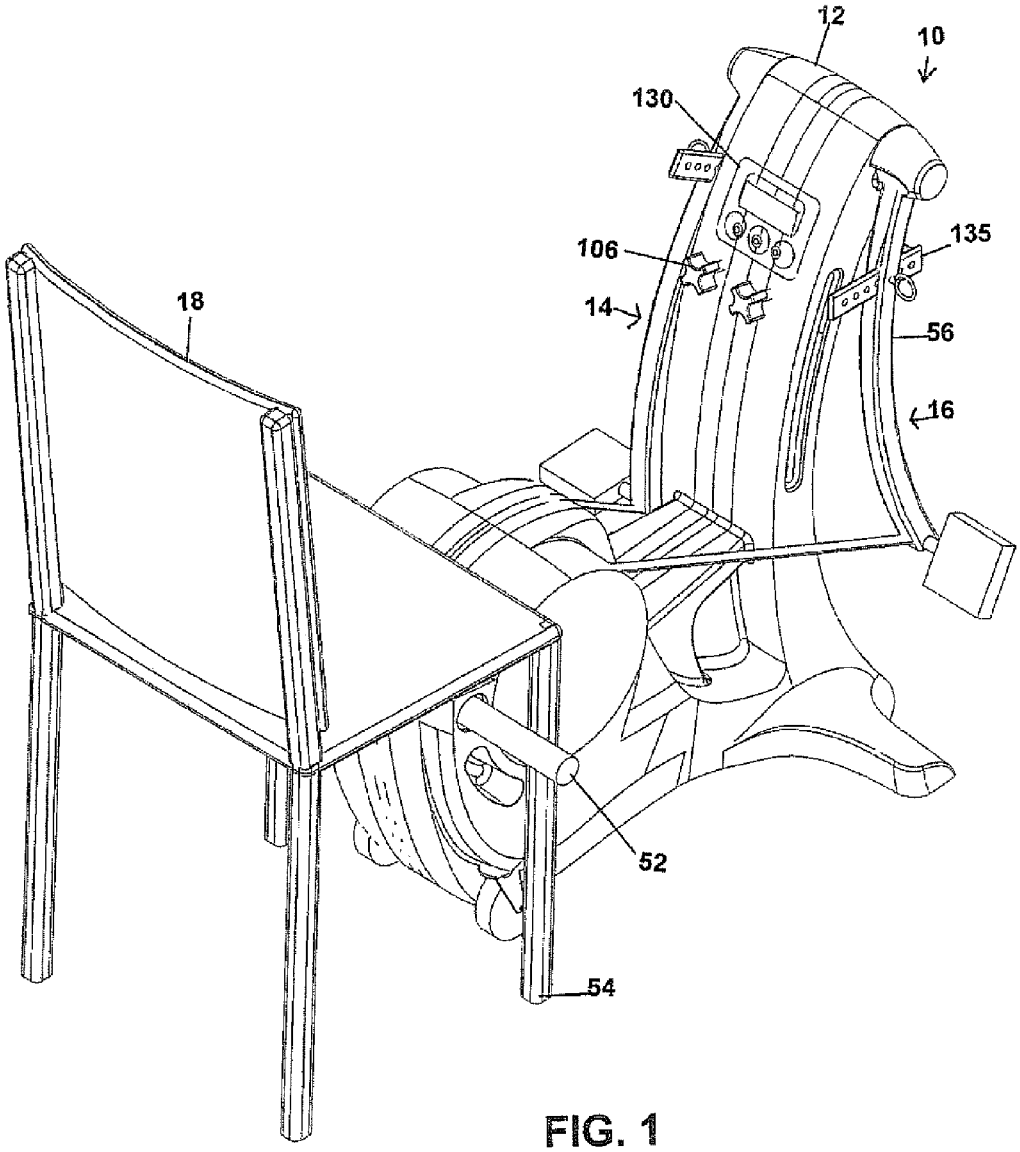
FIG. 1 is a perspective view of the recumbent stepper constructed in accordance with the present invention, shown in association with a chair.
Figure 2:
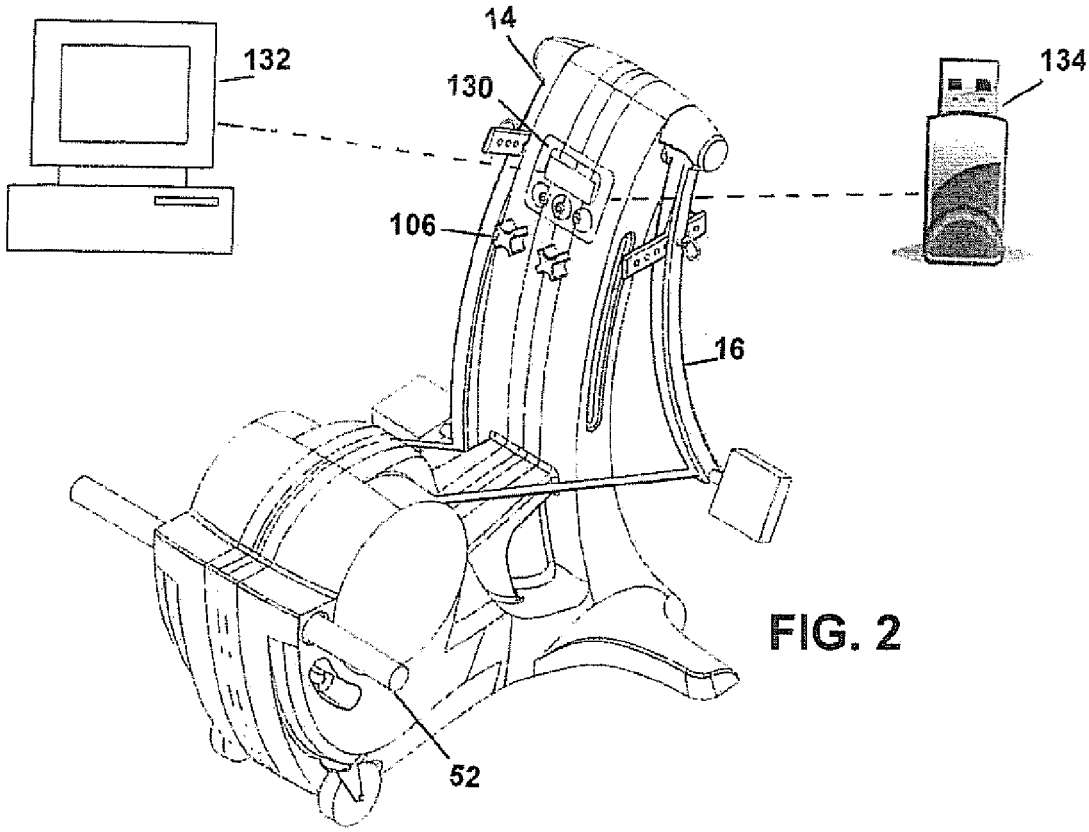
FIG. 2 is a perspective view of the recumbent stepper of the present invention.
Figure 3:
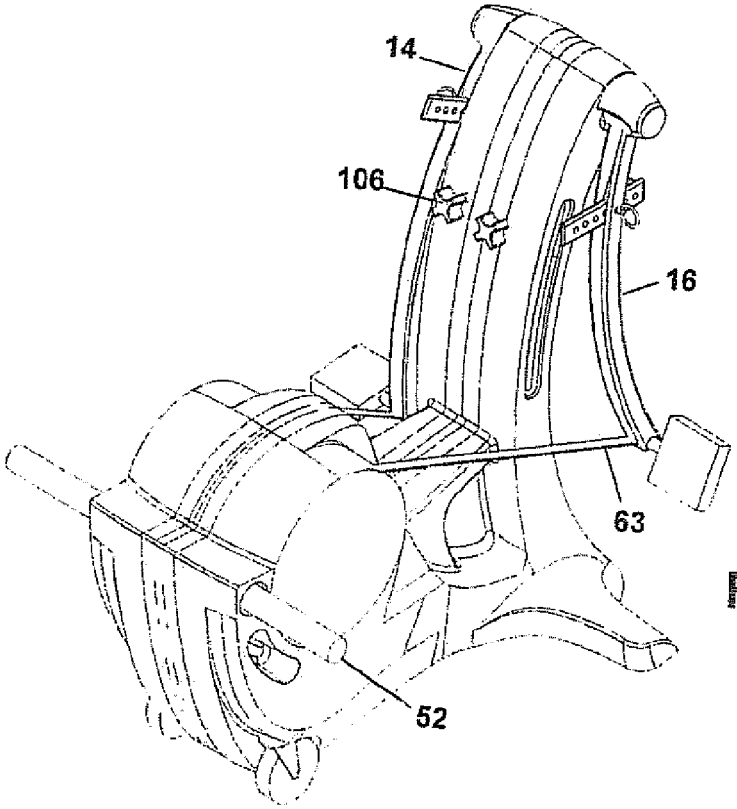
FIG. 3 is a perspective view of another embodiment of the recumbent stepper similar to that shown in FIG. 2 but without a display screen.

Referring to FIG. 1 the recumbent stepper 10 of the present invention includes a frame 12 and a pair of left and right tangent lever system 14, 16.

Figure 14:
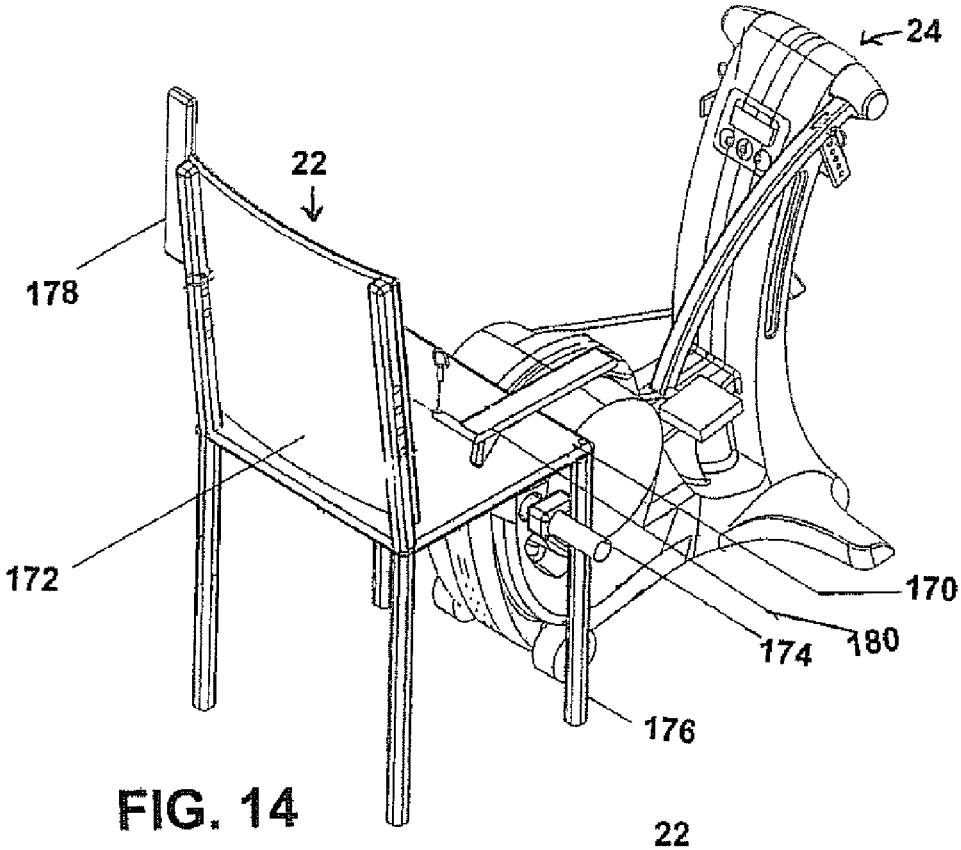
FIG. 14 is a perspective view of the recumbent stepper of the present invention shown with a chair attached thereto.
Figure 15:
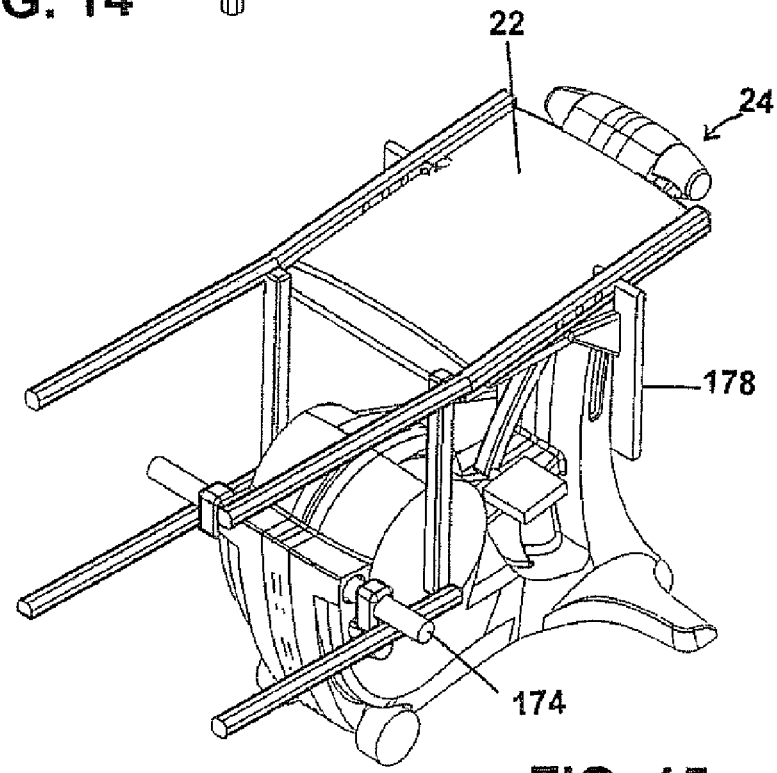
FIG. 15 is a perspective view of the recumbent stepper of the present invention similar to that shown in FIG. 14 but showing the chair in the folded position.
Figure 16:
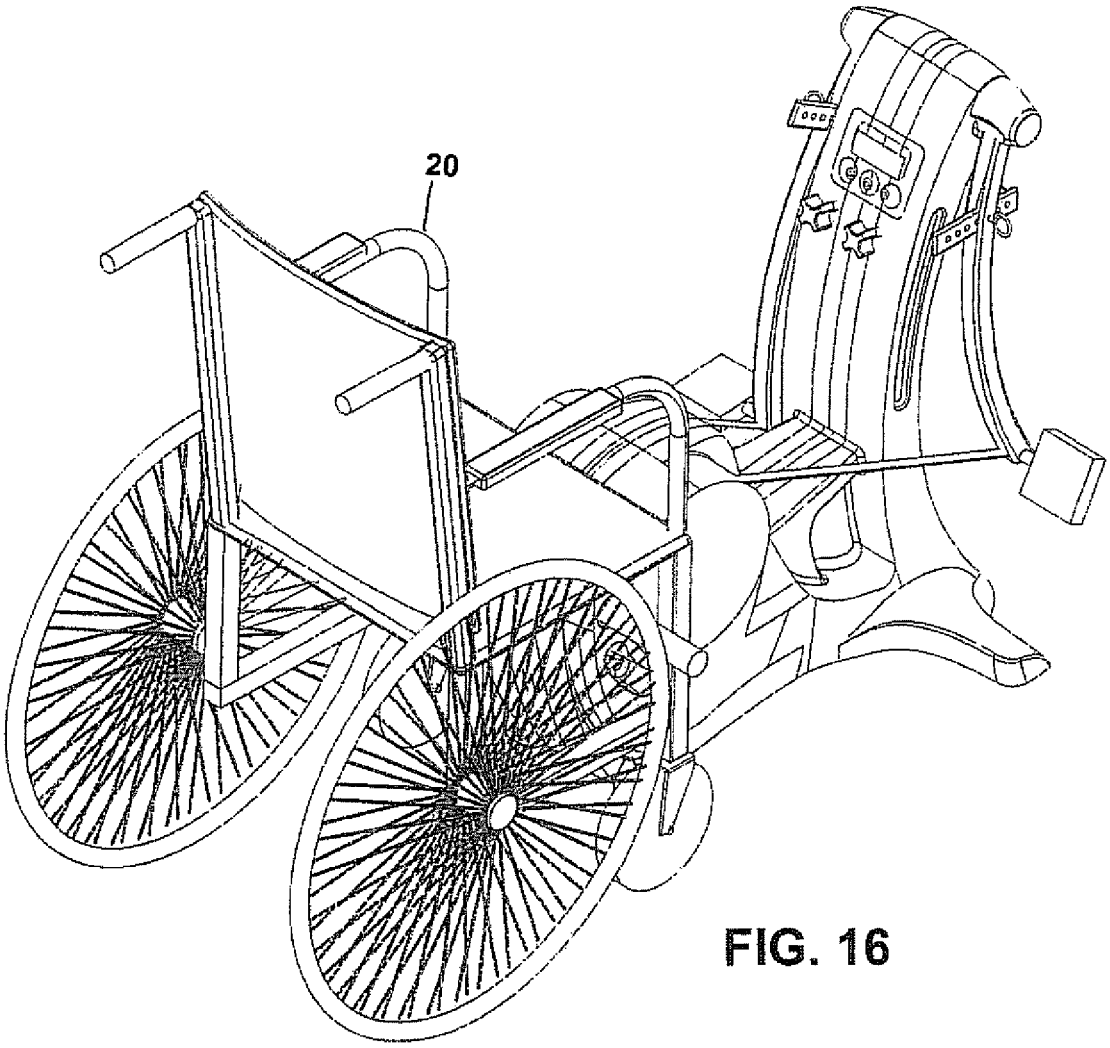
FIG. 16 is a perspective view of the recumbent stepper of the present invention shown in association with a wheel chair.

In one embodiment the frame 12 is releasably attachable to a chair 18 as shown in FIG. 1. In another embodiment the frame 12 is releasably attachable to a wheel chair 20 as shown in FIG. 16. Alternatively as shown in FIGS. 14 and 15 a chair 22 may form part of the device 24. It will be appreciated by those skilled in the art that the recumbent stepper 10 may be attached to a wide variety of chairs and that the chairs shown herein are by way of example only.

Figure 6:
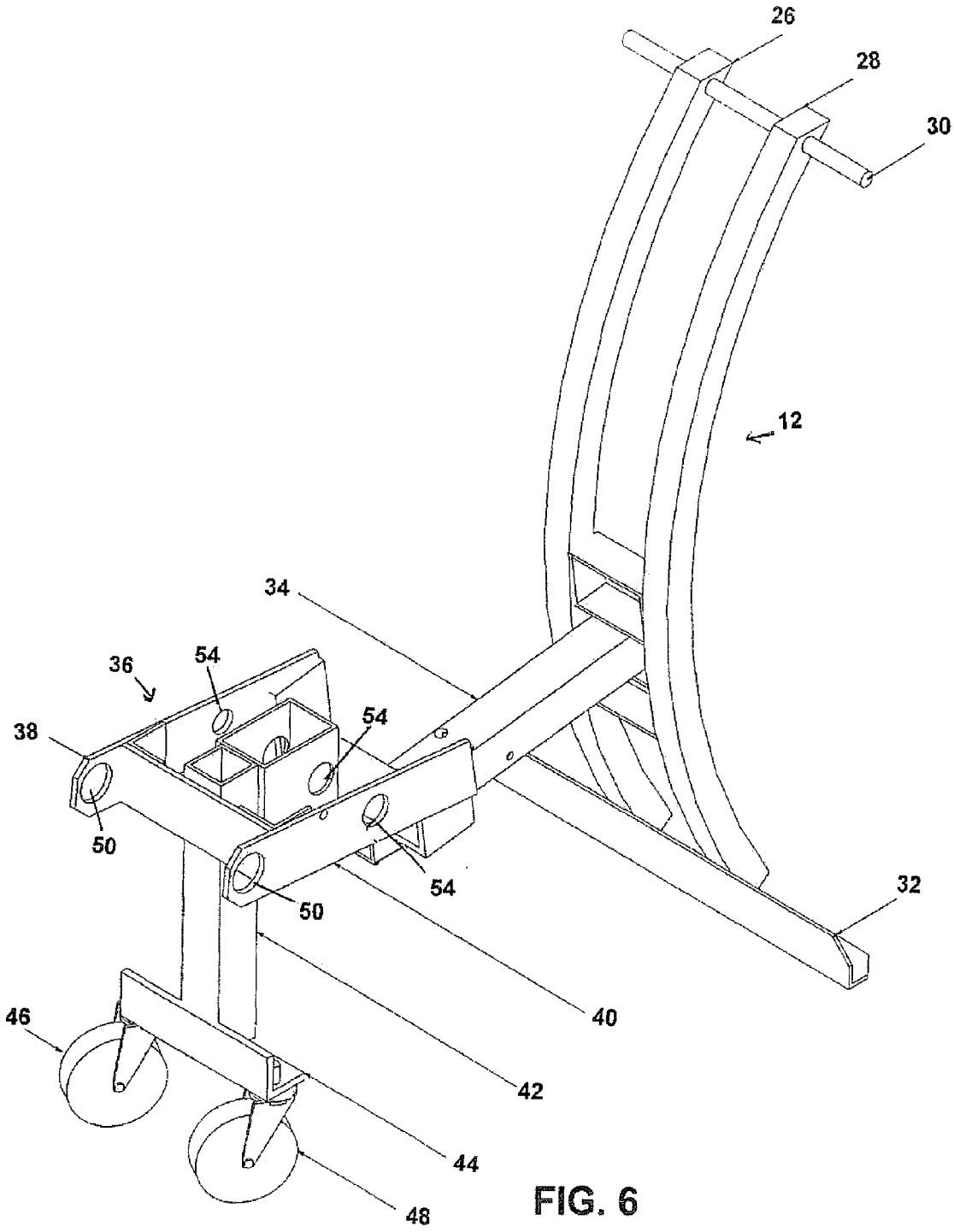
FIG. 6 is a perspective view of the frame of the recumbent stepper of the present invention.

As best seen in FIG. 6, the frame 12 includes a pair of left and right shaft frame members 26, 28. The left and right tangent lever systems 14, 16 (shown in FIGS. 1 to 4) are pivotally attached to lever shaft 30 which are attached to left and right shaft frame members 26, 28. Right and left pivot shaft frame members 26, 28 are attached together with the shaft 30 and a foot plate 32. Foot plate 32 is designed to support the weight of the device 10. Bridge member 34 connects the pivot shaft frame members 26, 28 to the rear portion of the frame 36. The rear portion of the frame 36 includes a right and left arm 38, 40 and a leg 42 extends downwardly therefrom. A cross member 44 is attached to leg 42 and right and left casters 46, 48 are attached thereto. Arms 38, 40 each have a chair rod bore 50 formed therein adapted to receive chair rod 52 (shown in FIG. 4). Outer bushing bores 54 are formed in the arms 38, 40.

The chair rod 52 is preferably a removable rod which passes through the bores 50 in the arms 38, 40 of frame 12. The chair rod 52 is positionable behind the front legs of a chair 18 on which the operator sits.

Figure 4:
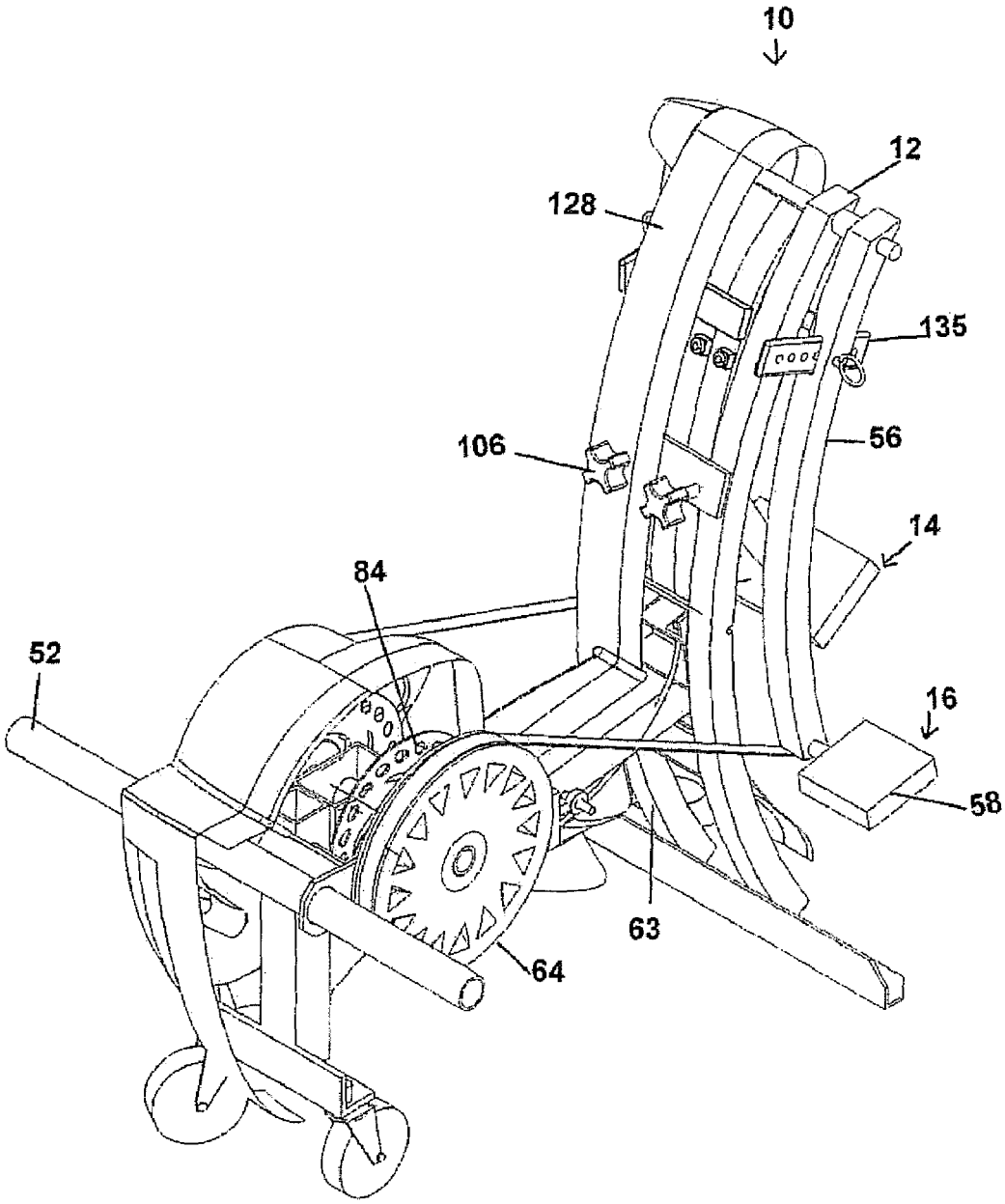
FIG. 4 is a perspective view of the recumbent stepper of the present invention, shown with half of the cover removed.
Figure 5:
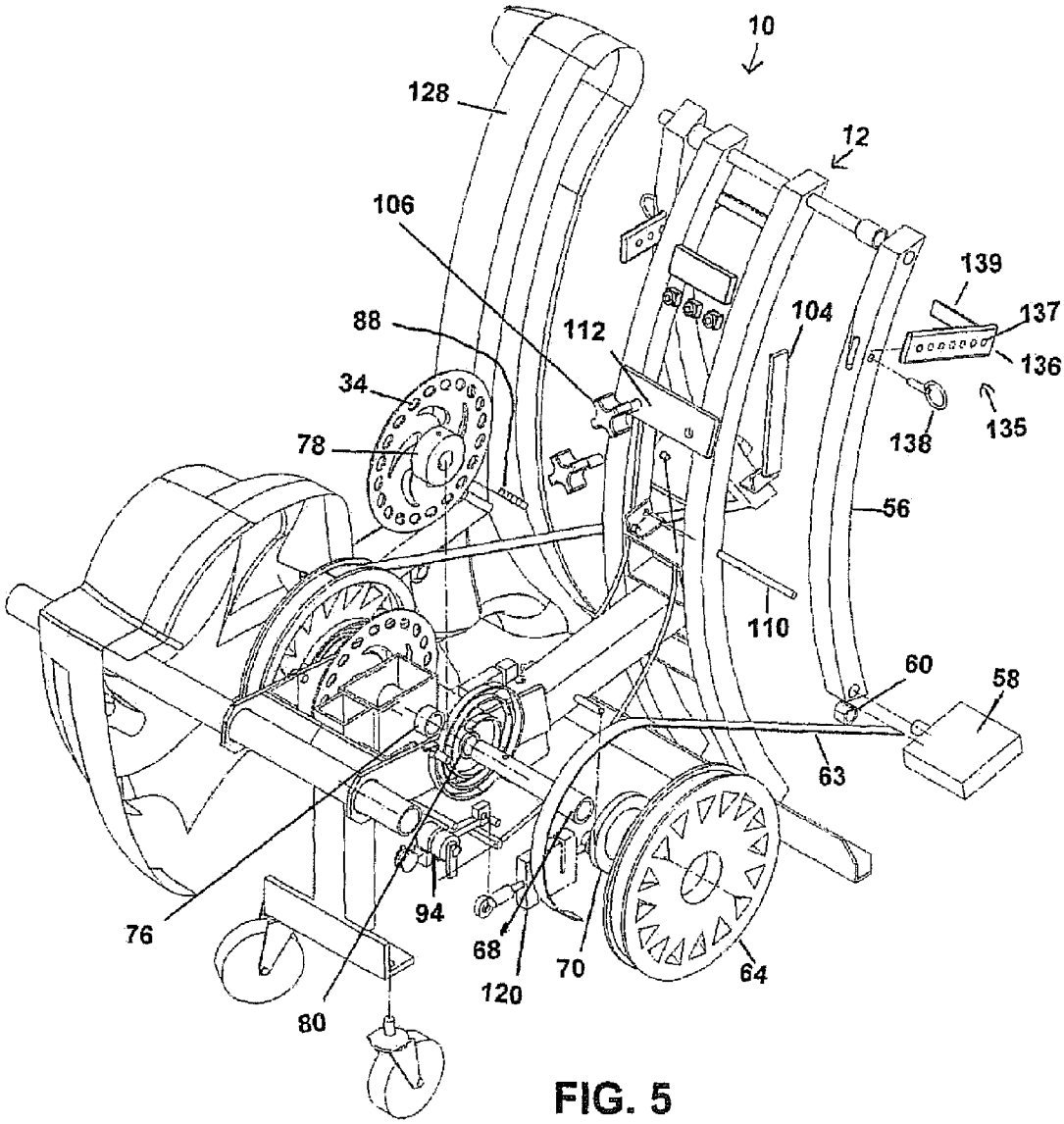
FIG. 5 is a perspective view similar to that of FIG. 2 but shown with half of the stepper blown apart.
Figure 7:
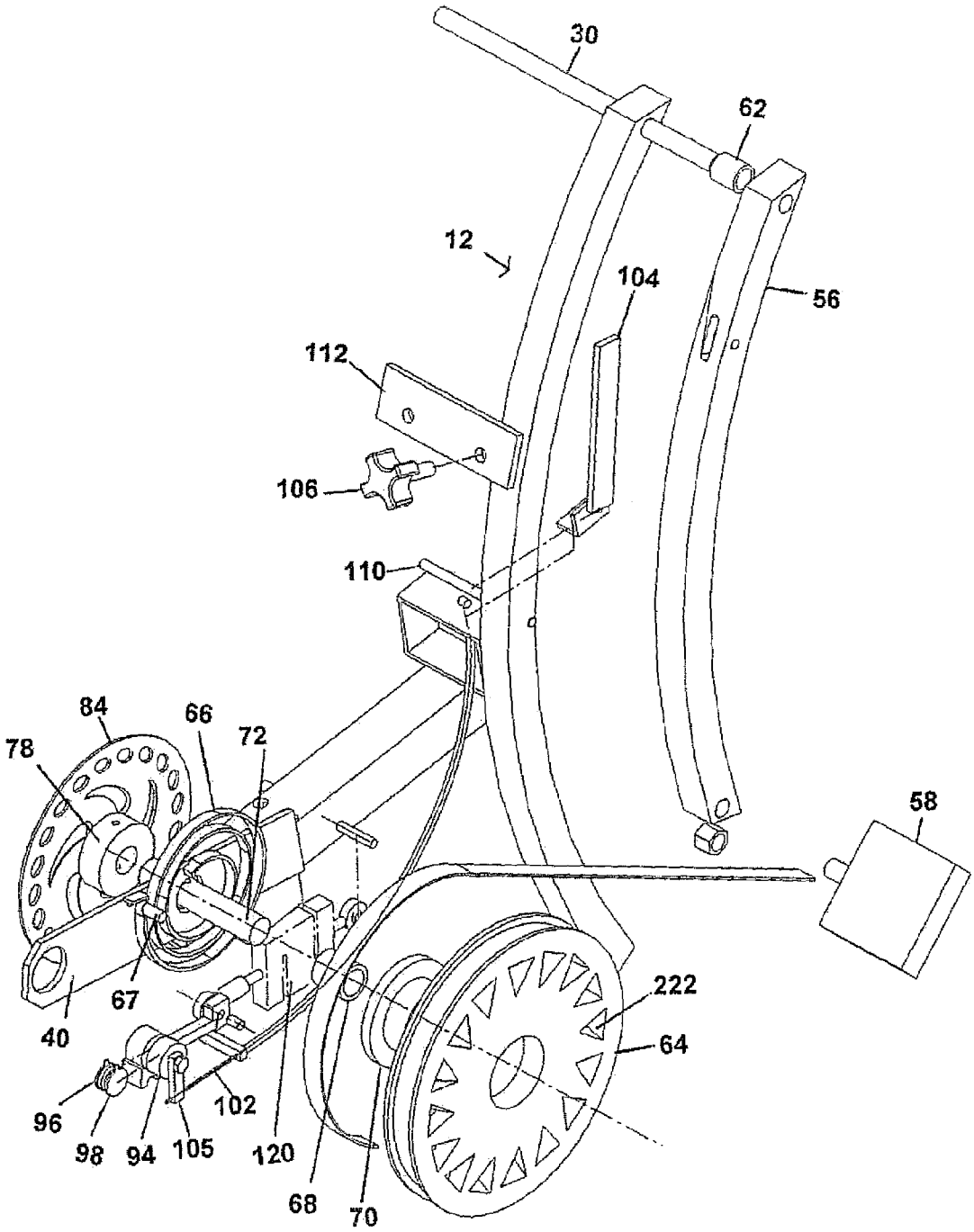
FIG. 7 is a blown apart perspective view of the right hand side tangent lever system of the recumbent stepper of the present invention.

As can be seen in FIGS. 4, 5 and 7, each tangent lever systems 14, 16 has a lever arm 56 pivotally attached to shaft 30. A pedal 58 is attached to each lever arm 56 proximate to the distal end thereof. A pedal nut 60 may be used to attach each pedal 58 to each lever arm 56. Alternatively pedal 58 may be attached to the lever arm 56 without a nut 60. A bushing 62 is positioned on the shaft 30 and is pressed into lever arm 56. The lever arm 56 moves between a retracted and extended position.

Each pulley 64 is rotatably attached to frame 12. Each flexible member 63 is attached between the respective pulley 64 and respective pedal 58. Preferably the flexible member 63 is a non elastic strap. Pulley 64 has a flat strap groove around the circumference, a strap anchor hole in strap groove, a clutch hub hole in center and a spring pocket on one side thereof. Each pulley 64 has a spring 66 attached thereto to bias the pulley and therethrough the lever arm into the retracted position. Preferably spring 66 is a flat stainless steel spiral spring wound within the pulley pocket with inner end attached to clutch hub and the outer end attached to frame 12. A stud 67 protrudes from the arm 40 of frame 12 and it engages a loop on the outer end of the spiral spring 66. Pulley 64 is rotatably attached to frame 12 through resistance shaft 72.

A right and left clutch 68 is operably connected between the frame 12 and the respective pulley such that the pulley freewheels when the lever moves from the extended position to the retracted position. Preferably the clutch 68 is a roller clutch. Preferably clutch 68 is a mechanical component (preferred type supplied by Torrington) that is pressed into a clutch hub 70 and slipped onto a resistance shaft 72 such that left roller clutch free wheels in clockwise direction and right roller clutch free wheels in the counter clock wise direction. Clutch hub 70 is a metal hub with finished bore into which roller clutch 68 is pressed and is inserted into bore in pulley 64. The shaft 72 is a metal shaft with finish surface to accept roller clutch 68 and is supported by outer bushing 74 and center bushing 76 and accepts disc hub 78. An outer bushing 80 is positioned in finished bore for resistance shaft 72 to slip into, attached to a hole in arm 38 of frame 12. A center bushing 76 is a metal hub with finished bore through which resistance shaft 72 is attached and to which friction disc 74 is attached such that it rotates around resistance shaft 72 axial center.

Figure 8:
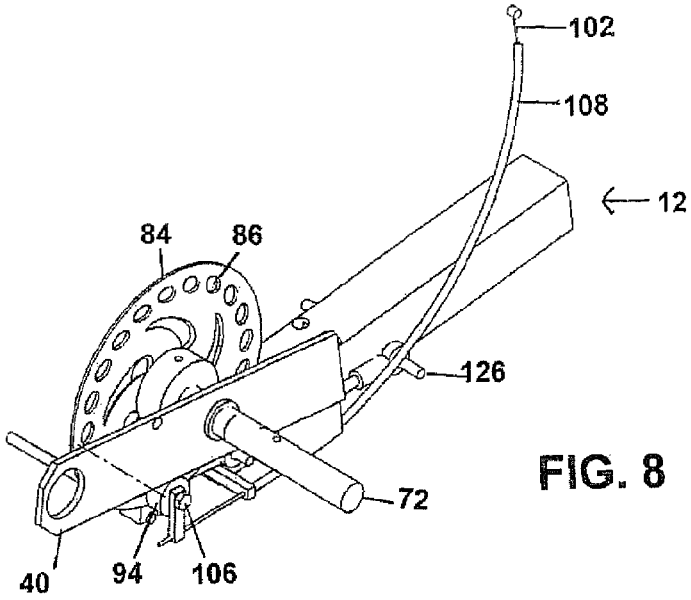
FIG. 8 is a perspective view of the resistance portion of the right hand tangent lever system of FIG. 7.
Figure 9:
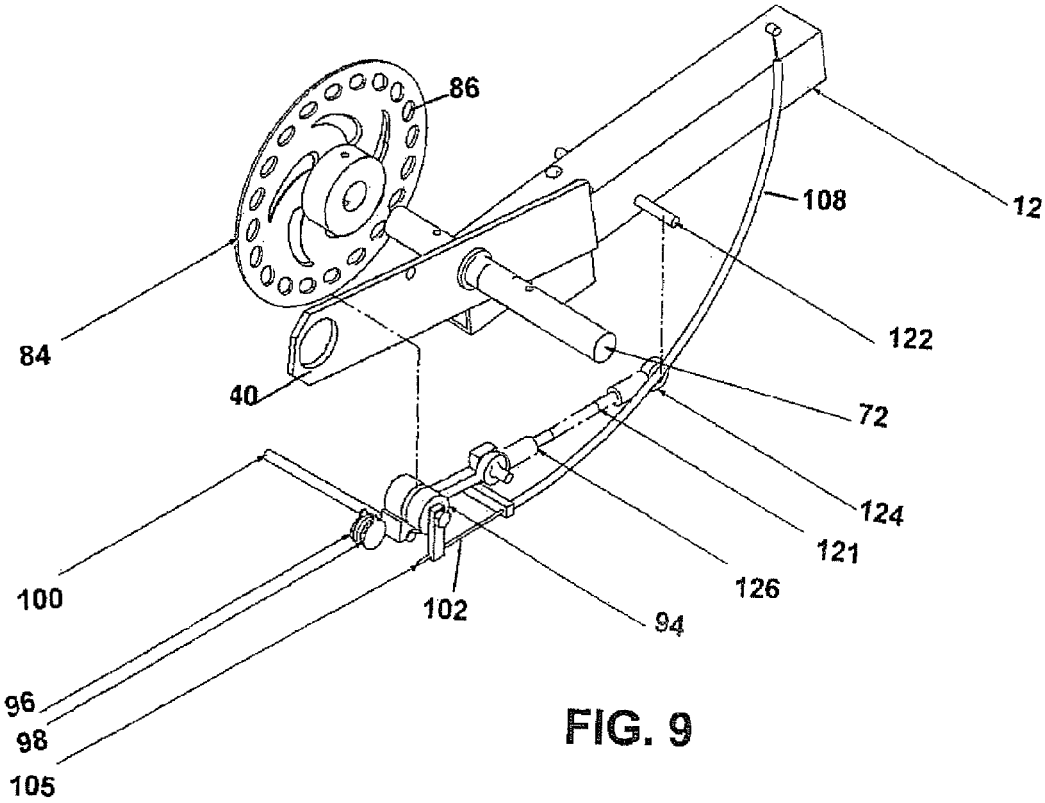
FIG. 9 is a blown apart perspective view of the resistance and monitoring portion of the right hand tangent lever system shown in FIG. 8 but shown without the strain gauge.

A friction disc 84, as seen in FIGS. 7 to 9, is a flat round metal disc that is attached to the disc hub 78. Friction disc 84 has a plurality of evenly spaced holes 86 proximate to the perimeter of the disc and the holes 86 define a circle that is just smaller than the outside diameter of the disc. An optical switch 88 is mounted on the frame 12 such that a light beam from optical switch 88 passes through holes 86 as the disc 84 turns. Optical switch 88 is a device which uses an electric current to project a small focused beam of infrared light across a gap to a receiver, which produces an electrical signal if the beam is being received. The optical switch is operably connected to a control system or chip attached to a display 92 if present.

A resistance caliper 94 is attached to the frame 12 and straddles the friction disc 84. Caliper 94 holds a station friction pad 96 and a moveable friction pad 98 in place. Stationary friction pad 96 is mounted on a metal backing plate and is attached in a fixed position to the resistance caliper 94 such that the friction surface is parrallel to the friction disc 84 surface. The pad area of the stationary friction pad 96 is projected normal to its exposed surface (parrallel to the resistance shaft axis of rotation) this projected area contacts the friction disc 84. Moveable friction pad 98 is a friction material which is mounted on a metal backing plate and is attached in a moveable position to the resistance caliper 94 such that the friction surface is parallel to the friction disc 84 surface such that if the pad area is projected normal to its exposed surface (parrallel to the resistance shaft axis of rotation) this projected area would all contact the friction disc 84. A caliper support bolt 100 (shown in FIG. 9) passes horizontally through the frame member 12 and supports the calipers 94 vertically but does not restrict the calipers movement horizontally. A cable 102 operably connects the calipers 94 to a force lever 104 and in turn to a knob 106 (shown on FIG. 5) which is adjustable by the operator. Cable 102 is a steel cable connecting the caliper actuation lever 105 to the force levers 104 to transfer the movement of the force levers 104 to the caliper levers 105. Cable 102 is provided with a cable sheath 108 which is a flexible sheath that is not compressible axially and which the cable 102 passes through and moves freely within. The force lever 104 is a lever actuated by the threaded shank of the force adjustment knob 106. The force lever 104 pivots on the lever pivot shaft 110 and pulls the cable 102. The lever pivot shaft 110 is a shaft on which the force levers 104 pivot and connected to the frame 12. Knob 106 is a hand actuated knob, preferably with an ergonomic rubber grip. Knob 106 is operably connected to a knob plate 112 attached to the frame 12. Knob 106 is connected such that it faces the operator. Knob 106 is connected to a threaded shank that turns in a mating threaded hole in the knob plate 112 so that the end of the shank advanced against the force lever 104. Calipers 94 are moveable responsive to the caliper actuation lever 106 that is actuated by a cable 102 such that the space between the friction pads 96, 98 is reduced when the lever is actuated against its spring return.

The stepper includes a device for determining an accurate work measurement. Specifically it includes a strain gauge 120 that is operably connected to the pulley 64 for determining the load on the pulley. Strain gauge transducer 120 is a commercially available component that converts the tensile load applied along the center line of the pulley 64 to a proportional electric voltage. Strain gauge transducer 120 is attached between the frame 12 by way of an anchor bolt 122 and calipers 94 with male rod end 124 and female rod end 126.

It will be appreciated by those skilled in the art that a basic version of the device may also be produced which does not include a strain gauge 120 as shown in FIG. 9 wherein a connector 121 is used to connect male rod end 124 and female rod end 126. This version would like be used in association with the basic version of the device shown in FIG. 3, specifically the version without the display panel.

A cover 128, as shown in FIGS. 4 and 5, houses the frame 12 and a portion of the right and left lever tangent lever systems 14, 16 as can be seen in FIGS. 1 to 4. The recumbent stepper 10 may have a digital display 130. The digital display 130 may be connected to a computer 132 either wirelessly or with a wire or by way of thumb drive 134 so that the data from the digital display may be stored and progress may be tracked.

The left and right tangent lever system 14, 16 may also each include a return stopper 135 whereby the retracted position may be varied. Specifically the return stopper includes a return stop bar 136 having a plurality of holes therein 137 adapted to receive a return stop pin 138. The return stop bar 136 is attached to the lever arm 56 and the position is adjusted by the position of the return stop pin 138. A stopper 139 extends outwardly from the return stop bar 136 such that it hits the frame 12 thereby stopping the movement of the lever arm 56 and defining a retracted position. Preferably stopper 139 is a leaf spring so that when the operator moves the lever arm into the retracted position it is a "soft" stop.

Figure 10:
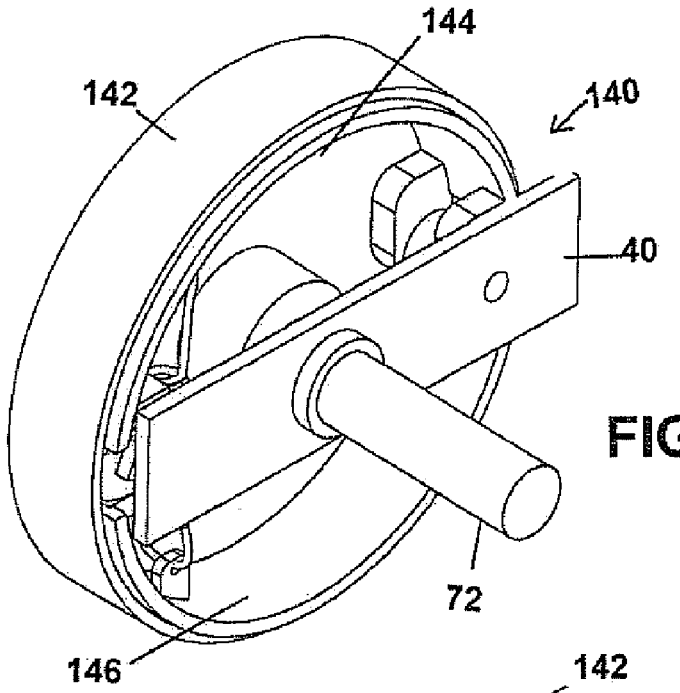
FIG. 10 is a perspective view of an internal brake drum for use as an alternate resistance portion of the right tangent lever system of the recumbent stepper of the present invention.
Figure 11:
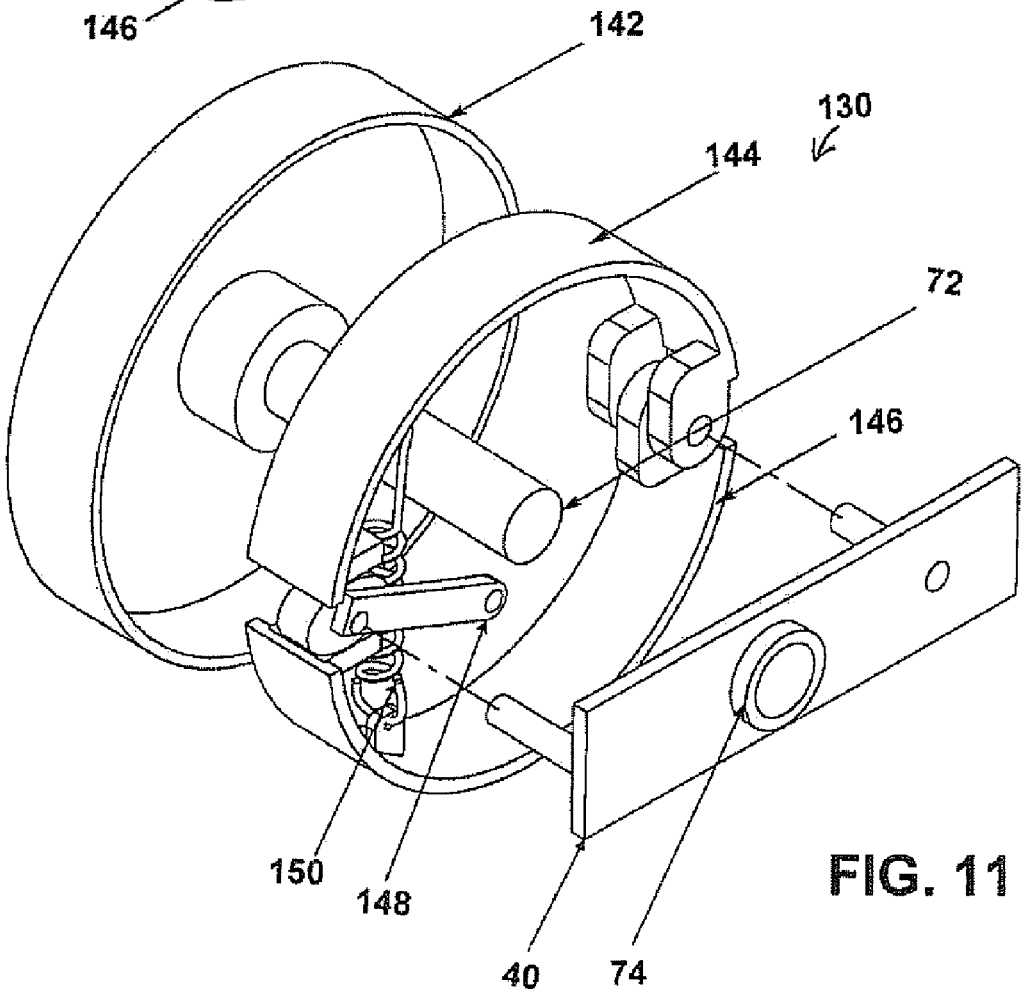
FIG. 11 is a blown apart perspective view of the internal brake drum shown in FIG. 10.
Figure 12:
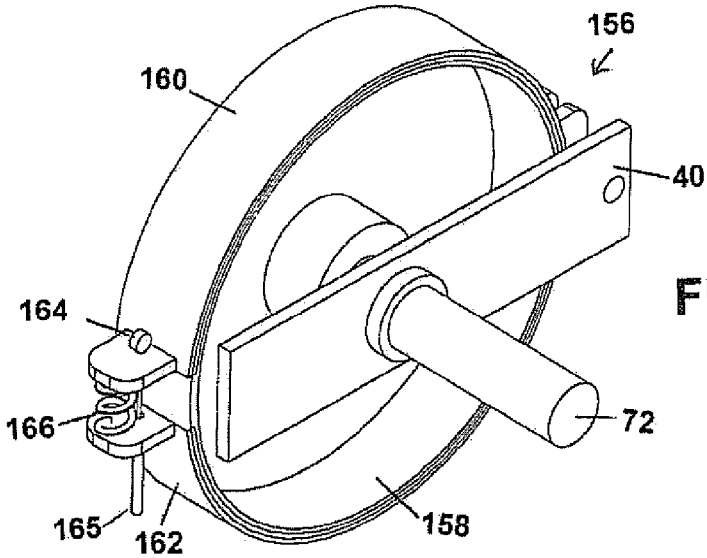
FIG. 12 is a perspective view of an external brake drum for use as an alternate resistance portion of the right tangent lever system of the recumbent stepper of the present invention.
Figure 13:
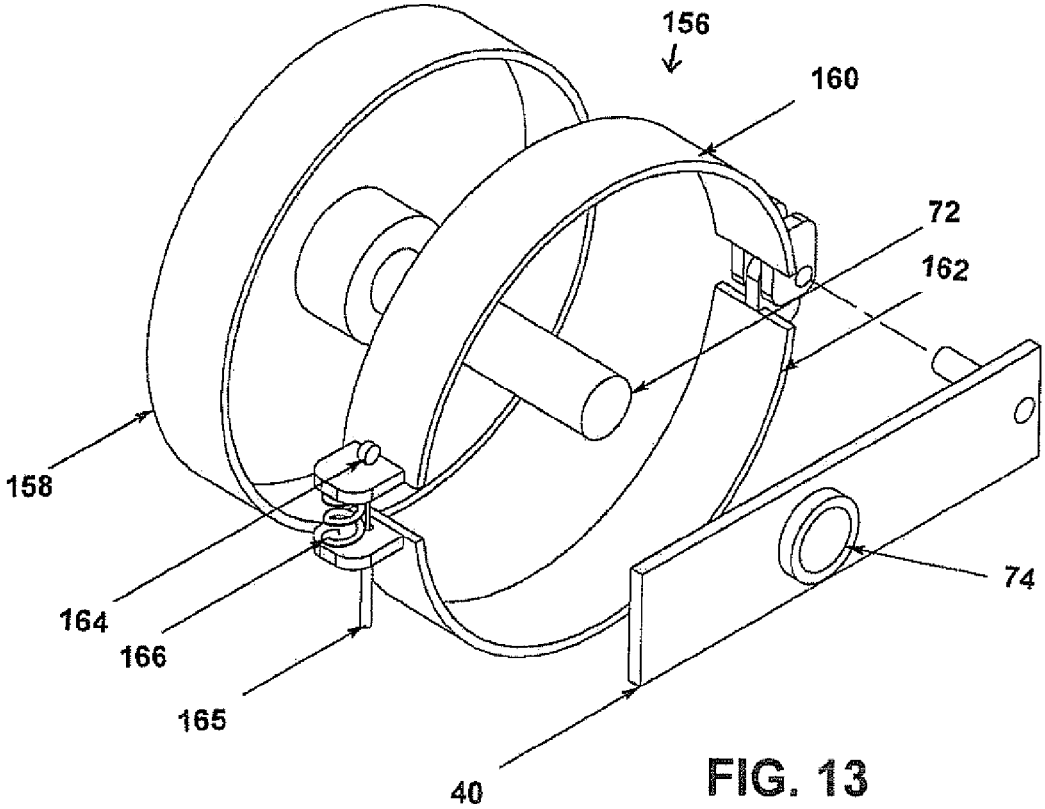
FIG. 13 is a blown apart perspective view of the external brake drum shown in FIG. 12.

It will be appreciated by those skilled in the art that there are a number of ways of providing resistance to the pulley 64 of the recumbent stepper 10. For example an internal brake drum 140 is shown in FIGS. 10 and 11 and an external brake drum 156 is shown in FIGS. 12 and 13.

Internal brake drum 140 includes a drum 142 attached to the resistance shaft 72. Upper 144 and lower 146 internal shoe are moveable into contact with the drum 142. A cam or internal shoe lever 148 is pivotally connected to arm 40 of frame 12. A return spring 150 is a tension spring that connects the upper internal shoe 144 to the lower internal shoe 146 and pulls the shoes away from the drum 142 when the cam or lever 148 is released.

External brake 156 includes a drum 158 attached to the resistance shaft 72. Upper 160 and lower 162 external shoe are moveable into contact with the drum 158. A cam or external shoe cable 164 is operably connected to arm 40 of frame 12. A sheath 165 protects the cam shoe cable 164. A return spring 166 is a compression spring that connects the upper external shoe 160 to the lower external shoe 162 and pushes the shoes away from the drum 158 when the cam or lever 164 is released.

One of the advantages of the embodiment of recumbent stepper 10 shown in FIGS. 1 to 5 is that it can be easily moved and it can easily be used with a wide variety chairs that have two front legs. However, in an alternate embodiment a chair 22 may form part of the device as shown in FIGS. 14 and 15.

Chair 22 has a seat 170 and a back 172 which is a component of the chair 22 for the operator that is integrated with the rest of the recumbent stepper 24. The seat 170 and back 172 provide optimum positioning and support. The chair 22 can be transport while attached to the recumbent stepper device 24. The recumbent stepper 24 is essentially the same as the recumbent stepper 10 described above except that the chair 22 is attached to the chair rod 174. The front legs 176 of the chair 22 are attached to the chair rod 174 and chair rod is pivotally attached to the frame 12 whereby the chair can be pivoted from the in use position shown in FIG. 14 to the transport position shown in FIG. 15. Preferably the chair has arm rests 178 that are pivotally attached to the back 172 at the sides thereof. A central support 180 attaches the seat 170 to the frame and is moveable from the in use position to the transport position.

As shown in FIG. 16 the recumbent stepper 10 can also be easily used with a wheel chair 20.

There are a number of advantages that are realized by the embodiments herein. For example the recumbent stepper of the present invention is portable. Further in at least one embodiment it can be used in association with a standard chair. It includes an attachment means that allows the recumbent stepper to be easily attached to standard chair.

The recumbent stepper 10 is designed to be portable and preferably is of a size and weight that a person who is able to walk will be able to move. The fore aft weight distribution of the device is biased away from the front, where the transport handhold (not shown) is located. PLEASE CONFIRM. Two wheels 46, 48 under the rear of the device provide stability. These wheels 46, 48 rotate about a common horizontal axis that is perpendicular to the main fore aft axis of the stepper 10 and primary direction of transport movement. These wheels 46, 48 can also swivel about a vertical axis to provide maneuverability during transport. The stepper 10 is sized to fit through standard doorways.

The stepper 10 is used from a sitting position as provided by a standard chair of a variety of common designs that have four legs, a horizontal seat with height of approximately 17 inches and a back angle of between 0 and 15 degrees from vertical. This would include wheelchairs 20 as discussed above.

The stepper 10 easily connects to a chair 18 by means of a single rod 52 that is positioned behind the front legs of the chair 18. This rod 52 is free to be removed from the mating sleeve in the device from either side and then be inserted back through the device after the device has been located such that the chair rod 52 is behind the chair's front legs. This rod 52 resists movement of the stepper 10 away from the chair due to the foreward force that the operator exerts on the stepper 10 during use. No other connection activity is required.

The operator (patient) can be seated in the chair 18 before the stepper 10 is positioned for attachment and use. The stepper 10 is easily maneuverable due to the little effort required to move it and dual caster wheels 46, 48 at the chair end. The attachment to the chair via the simple horizontal transverse rod 52 is extremely simple and fast.

As discussed above the left and right lever systems 14, 16 are independent of each other. Thus someone could exercise only one leg or they could have different range of motion for each leg and still use the stepper 10. As well, they could have different resistance on each leg.

Figure 17:
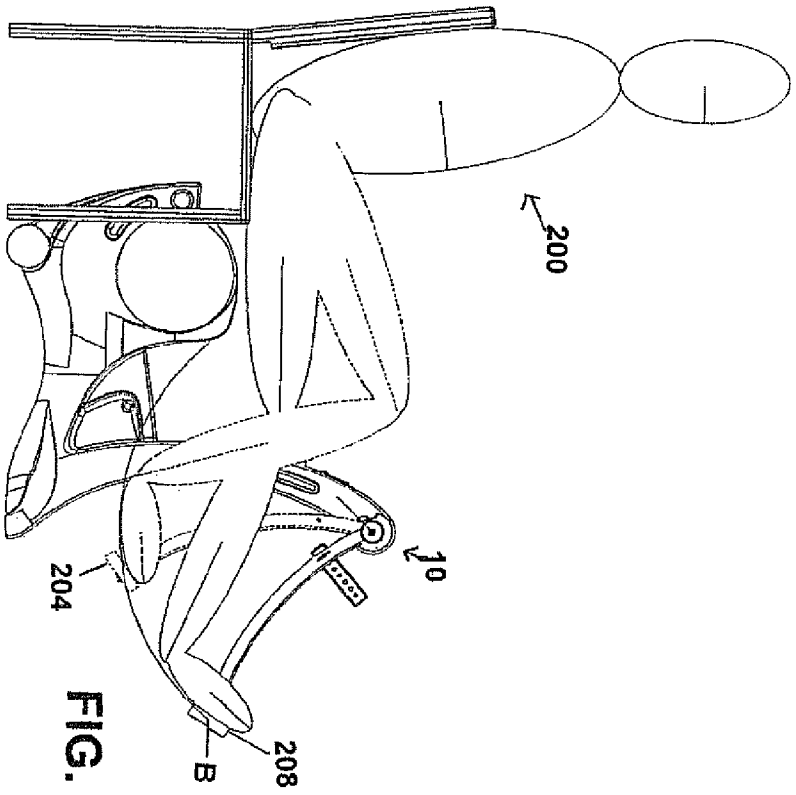
FIG. 17 is a perspective view of the recumbent stepper of the present invention showing the range of motion for a person 6 foot 4 inches tall.
Figure 18:
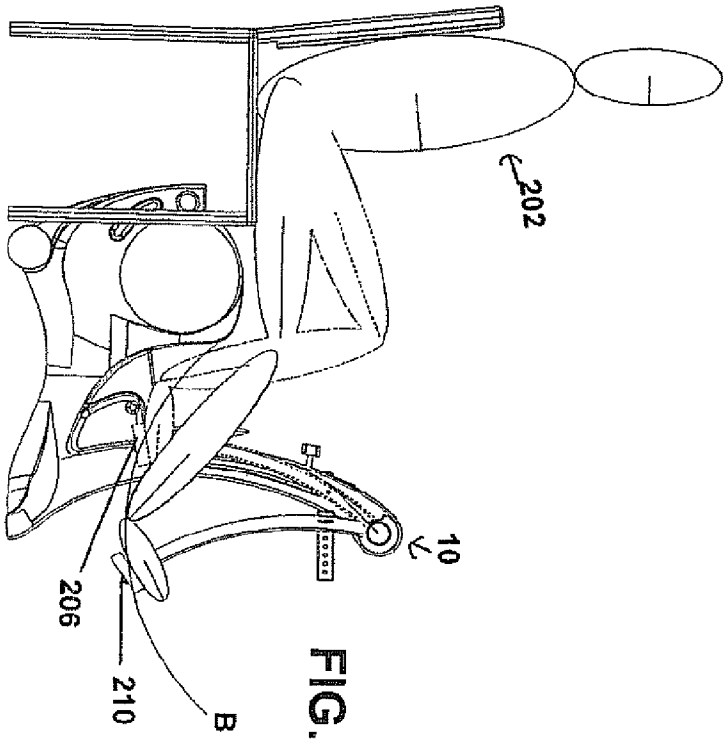
FIG. 18 is a perspective view of the recumbent stepper of the present invention similar to that in FIG. 17 but for a person 5 foot 2 inches tall.

The range of stroke of the lever arm 56 and pedal 58 of the stepper 10 accommodates adult users of any height. The entire range pedal travel available begins with the pedal retracted to the bodywork just in front of the operator's seat and in one embodiment extends forward 26 inches. Referring to FIGS. 17 and 18 the fully retracted position is shown at A and the fully extended position is shown at B and the distance between A and B is 26 inches. The maximum leg stroke for the an operator 6 foot 4 inches is 14 inches, therefore, the entire spectrum of operator starting and ending points is contained within the range of pedal 58 travel, making adjustment based on operator height unnecessary.

The end of the return stroke or the retracted position may be set by use of return stop bar 136 as described above. Therefore, the minimum knee angle can be set independently for each leg by an adjustable stop on each lever. Referring to FIG. 17 the stepper 10 is shown with a 6 foot 4 inch operator 200 and referring to FIG. 18 the stepper 10 is shown with a 5 foot 2 inch operator 202. As can be seen the starting or retracted position 204 is quite different for tall operator 200 than the retracted position 206 for small operator 202. Similarly the extended position 208 for tall operator 200 is quite different than the extended position 210 for short operator 202. Further, the starting, and ending point of the leg stroke is completely independent for each leg. As discussed above, the left and right legs operate mechanisms that are completely separate, to the extent that a one-legged operator can use the device. The return stroke stop 136 is spring loaded to provide a soft stop for the operator.

The resistance force to movement of the pedal 58 by the operator can be set independently for the needs of each leg. The movement of each leg drives a separate pulley 64. This pulley 64 drives a shaft 72 on which a brake or friction disc 84 is rigidly mounted. A brake caliper 94 is mounted over each brake or friction disc 84 and is anchored to the device's chassis. The cable 102 that activates the lever 106, which moves each of the caliper's friction pads against the rotating disc, is actuated by a lever which is moved by the rotation of the left or right force adjustment knob 106.

The resistance setting is independent of the adjustment of the caliper 94 or wear of the brake pads 96, 98. The caliper 94 and the linkage that anchors it to the chassis incorporate spherical rod ends. These allow the caliper 94 to float transversely (parallel to the pulley shaft) to accommodate for brake pad wear and adjustment differences, without affecting the calipers parallelism alignment to the disc.

The resistance force is constant throughout the length of the leg stroke due to the constant tangential transfer of the operator's force to the resistance mechanism pulley 64. The operator force acts along a flexible tension member 63 in the form of a flat strap. This strap 63 is wrapped on a pulley so that the force to move the pulley is generally tangential at all points in the pedal travel. Therefore, the constant resistance of the mechanical brake is resisted by a constant force vector along the strap 63.

The resistance force is generally constant regardless of the operator's rate of stroke due to the mechanical brake used to provide the resistance force.

Mechanical brakes use friction to create resisting force. This is governed by the equation Force=Area×normal force× coefficient of friction for the contacting materials. Speed does not enter into this relationship, except at higher speeds, which are unlikely to be encountered in this design.

The calculation of work and power is based on force measurements taken over each inch or less of foot movement. The accuracy of the measurement is independent of stroke rate. This is achieved by using a photo eye signal or optical switch 88 to trigger reading the force measurement from the strain gauge transducer 120. This photo eye straddles the brake or friction disc 84 which has a series of holes 86 near the edge of the disc and evenly spaced around its perimeter. As the disc turns due to the input from the operator, the light beam can pass through and signal the switch as each hole passes by the beam. The disc does not turn during the return stroke and therefore no force measurements are taken when the operator is not contributing any work. The calculation of work and power is computed and displayed independently for each leg. There is a separate photo eye switch or optical switch 88 and strain gauge transducer 120 for each leg and the data is stored separately. All force, distance and time data is stored by leg for the duration of the therapy session. This is stored on a memory chip mounted on the device. The memory chip is attached to display panel 130. All force, distance and time data for the therapy session can be transmitted wirelessly to a computer 132 or to a thumb drive 134 for further analysis, comparison and storage.

As with all resistance mechanisms, the resisting force is created by converting the operator work into heat. This is done by the caliper pads sliding along the moving brake disc which is all located under the bodywork. The pulleys are equipped with slots, shaped to move air outward transversely as the pulley turns due the operator's foot retracting to the beginning of the stroke. Cooler fresh air is drawn up through the opening in the bottom of the bodywork, through the turning pulley to be exhausted through a hole in the bodywork covering the outer surface of the pulley. This air movement will transfer heat from the mechanical brake assemblies from under the bodywork.

Embodiments of present invention utilize generally all of the operator's linear input force, throughout the entire length of the stroke, to turn a fixed shaft that is providing a constant resisting torque. This is accomplished firstly by having the operator input lever rotate freely about a shaft. Secondly, a flexible tension member, in the form of a non elastic strap, transfers the operator's linear input force to the resisting force mechanism. The strap is wound on to a pulley that is rigidly affixed to the resisting shaft in the operator input direction. The strap pulls on the pulley tangentially at all points throughout the entire stroke range. Therefore, all of the operator force acts tangentially to the radius of the pulley, which is the resisting force lever.

Generally speaking, the systems described herein are directed to recumbent steppers. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to recumbent steppers.

As used herein, the terms "comprises" and "comprising" are to construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed as the invention is:

1. A recumbent stepper comprising:

a frame;

a pair of lever arm pivotally attached to the frame whereby each lever arm is movable from a retracted position to an extended position;

a pair of pedals pivotally attached proximate to the distal end of the respective lever arm;

a pair of pulleys rotatably attached to the frame;

a pair of flexible members attached between the respective lever arm and pulley, whereby the flexible member is wound around the pulley when the lever arm is in the retracted position and deploys as the lever arm moves to the extended position;

a pair of springs operably attached to the pulley whereby each lever arm is biased to the retracted position; and a pair of adjustable resistance devices operably connected to the respective pulley whereby increasing the resistance on the respective pulley increases the force required to move the respective lever arm from the retracted position toward the extended position, wherein each adjustable resistance device is one of a disc brake, an internal drum brake and an external drum brake.

2. The recumbent stepper as claimed in claim 1 further including a pair of clutches operably connected between the frame and the respective pulley whereby the pulley freewheels when the lever arm moves from the extended position to the retracted position.

3. The recumbent stepper as claimed in claim 2 further including a pair of monitoring devices operably attached to the respective pulley adapted to determine the force required to move the pulley from the retracted position to the extended position.

4. The recumbent stepper as claimed in claim 3 each lever arm further includes an adjustable stop whereby the retracted position is adjustable.

5. The recumbent stepper as claimed in claim 4 wherein each adjustable stop includes an adjustable post extending outwardly from each lever and adapted to engage the frame.

6. The recumbent stepper as claimed in claim 5 wherein the adjustable post includes a leaf spring that engages the frame.

7. The recumbent stepper as claimed in claim 3 wherein each disc brake includes a friction disc and an adjustable friction pad adapted to engage the brake disc.

8. The recumbent stepper as claimed in claim 7 wherein the friction disc includes a plurality of equally spaced holes formed therein proximate to the perimeter and wherein each monitoring device includes a photo eye signal adapted to read a force measurement from a strain gauge.

9. The recumbent stepper as claimed in claim 8 further including a display operably connected to each monitoring device and each resistance device.

10. The recumbent stepper as claimed in claim 9 wherein the display includes a chip adapted to save information regarding force, distance and time for each pulley.

11. The recumbent stepper as claimed in claim 10 wherein the display device is operably connected to a computer.

12. The recumbent stepper as claimed in claim 9 wherein the flexible member is a flat strap.

13. The recumbent stepper as claimed in claim 9 wherein the frame further includes casters attached thereto.

14. The recumbent stepper as claimed in claim 13 wherein the frame further includes a chair engaging device.

15. The recumbent stepper as claimed in claim 14 wherein the frame further includes a hole therethrough rearwardly of the pair of pulleys and the chair engaging device includes a generally elongate member adapted to be removably positioned in the hole and extending outwardly on either side of the frame, whereby the elongate member is adapted to engage the front legs of a four legged chair.

16. The recumbent stepper as claimed in claim 13 wherein the frame further includes a chair attached thereto rearwardly of the pair of pulleys.

17. The recumbent stepper as claimed in claim 16 wherein the chair is pivotally attached to the frame.

18. The recumbent stepper as claimed in claim 3 further including a display operably connected to each monitoring device and each resistance device.

19. The recumbent stepper as claimed in claim 3 wherein the frame further includes a chair engaging device.

20. The recumbent stepper as claimed in claim 19 wherein the frame further includes a hole therethrough rearwardly of the pair of pulleys and the chair engaging device includes a generally elongate member adapted to be removably positioned in the hole and extending outwardly on either side of the frame, whereby the elongate member is adapted to engage the front legs of a four legged chair.

21. The recumbent stepper as claimed in claim 3 wherein the frame further includes casters attached thereto.

22. The recumbent stepper as claimed in claim 3 wherein the frame further includes a chair attached thereto rearwardly of the pair of pulleys.

23. A recumbent stepper comprising:

a frame having a hole therethrough and a generally elongate member adapted to be removably positioned in the hole and extending outwardly on the either side of the frame, whereby the elongate member is adapted to engage the front legs of a four legged chair;

a pair of lever arm systems each having a lever arm pivotally attached to the frame whereby each lever arm is movable from a retracted position to an extended position; and a pair of pedals pivotally attached proximate to the distal end of the respective lever arm.

* * * * *